US005295422A

United States Patent [19]

Chow

[11] Patent Number: 5,295,422

[45] Date of Patent: Mar. 22, 1994

[54] WRENCH HAVING A GREATER DRIVING STRENGTH

[76] Inventor: Jessie Chow, No. 18, Houchuang Rd., Pei Twen Dist., Taichung, Taiwan

[21] Appl. No.: 51,239

[22] Filed: Apr. 23, 1993

[51] Int. Cl.[5] ..... B25B 23/16

[52] U.S. Cl. ..... 81/124.3; 81/177.85

[58] Field of Search ..... 81/124.3, 177.85

[56] References Cited

U.S. PATENT DOCUMENTS 2,651,230 9/1953 Waterval ..... 81/124.3

3,908,489 9/1975 Yamamoto et al. ..... 81/124.3

4,535,658 8/1985 Molinari ..... 81/177.85

*Primary Examiner*—Robert C. Watson

*Attorney, Agent, or Firm*—Bacon & Thomas

[57] ABSTRACT

A wrench for driving an object includes a circular engaging surface formed in a head portion, a number of ribs are formed in the circular engaging surface and extended radially inwards of the engaging surface, and the object includes a number of depressions for receiving the ribs such that the contact area between the ribs and the depressions are increased when the object is driven by the wrench.

2 Claims, 2 Drawing Sheets

WRENCH HAVING A GREATER DRIVING STRENGTH

BACKGROUND OF THE INVENTION

1. Field of the Invention

The present invention relates to a wrench, and more particularly to a wrench having a greater driving strength.

2. Description of the Prior Art

A typical wrench is shown in FIG. 3 and comprises a head portion 41 having an engaging surface 43 formed therein for engaging with an engaging surface 51 of a bolt or a socket 50, normally, the engaging surfaces 43, 51 include a hexagonal cross section, such that, when the socket 50 is engaged with the engaging surface 43 of the head portion 41 and during the driving operations of the wrench, only six points are contacted and engaged between the engaging surfaces 43, 51. Accordingly, after long term of usage, the engaging points of the engaging surface 51 of the socket 50 will be easily damaged.

The present invention has arisen to mitigate and/or obviate the afore-described disadvantages of the conventional wrenches.

SUMMARY OF THE INVENTION

The primary objective of the present invention is to provide a wrench which includes an improved engaging surface with which the driving strength of the wrench can be greatly increased.

In accordance with one aspect of the invention, there is provided a wrench for driving an object comprising a head portion, a circular engaging surface formed in the head portion, a plurality of ribs formed in the circular engaging surface and extended radially inwards of the engaging surface, and the object including a plurality of depressions formed therein for receiving the ribs, whereby, the ribs and the depressions have contact surfaces formed therebetween when the object is driven by the wrench.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
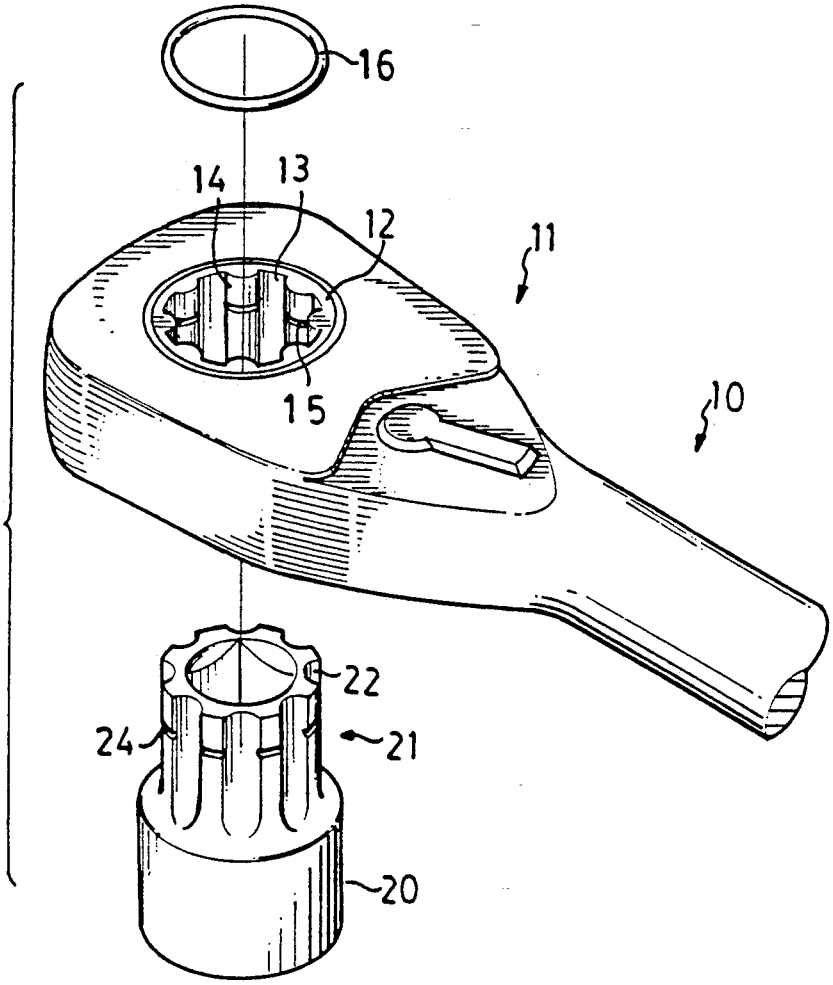
FIG. 1 is a perspective view of a partial exploded view of a wrench in accordance with the present invention.
Figure 2:
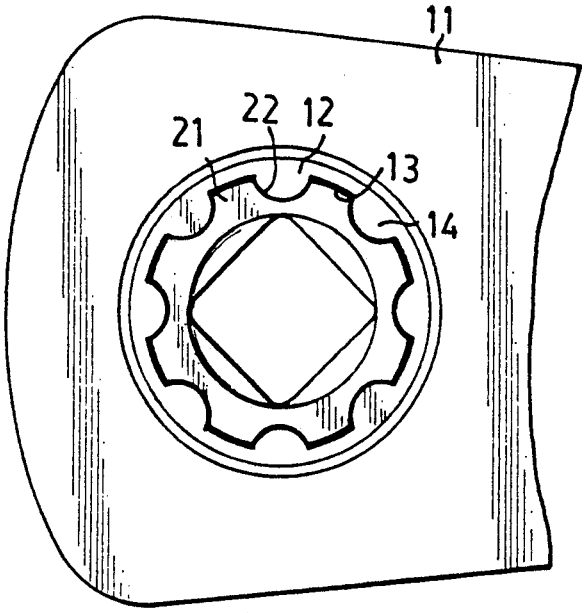
FIG. 2 is a top plane view of the head portion of the wrench.
Figure 3:
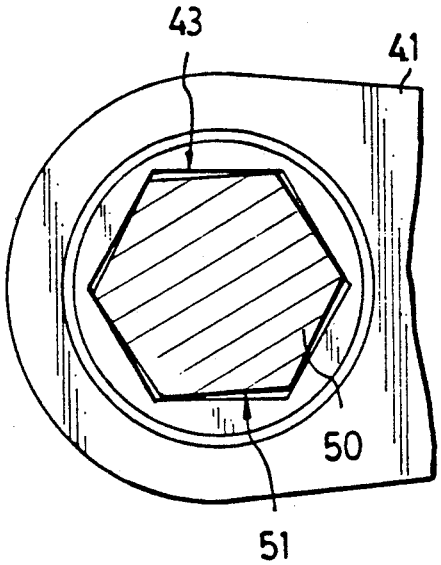
FIG. 3 PRIOR ART
FIG. 3 is a top plane view similar to FIG. 2, illustrating the head portion of the conventional wrench.

Referring to FIGS. 1 and 2, a wrench in accordance with the present invention comprises generally a handle portion 10 and a head portion 11 formed integral with each other, the head portion 11 includes a sleeve 12 rotatably engaged therein, the sleeve 12 is controlled by a control mechanism (not shown) which is provided in the head portion 11 such that the sleeve 12 can be controlled to be rotated in either direction, this is the so-called ratchet wrench. A circular or cylindrical engaging surface 13 is formed in the sleeve 12, and a plurality of ribs 14 are formed in the engaging surface 13 and extended radially inwards of the sleeve 12 and are equally spaced with each other. Each of the ribs 14 includes a slot 15 formed in the middle portion thereof so as to form an annular groove for receiving a ring element 16. Alternatively, without the sleeve 12, the engaging surface 13 can be directly formed in the head portion 11 of the wrench.

Correspondingly, the socket 20 to be driven by the wrench includes a barrel 21 formed in the upper portion thereof, and a plurality of equally spaced depressions 22 formed in the outer peripheral portion of the barrel 21 for engaging with the ribs 14 of the head portion 11. An annular groove 24 is formed in the outer peripheral surface of the barrel 21 for engaging with the ring element 16 such that the socket 20 can be solidly coupled to the head portion 11 and can be retained in place by the ring element 16.

As best shown in FIG. 2, when the barrel 21 of the socket 20 is engaged in the engaging surface 13 of the wrench and is rotated by the wrench, the contact portion between the barrel 21 and the engaging surface 13 is not points, the contact portion is surfaces such that the barrel 21 ca be solidly and firmly engaged with the engaging surface 13 and can be firmly driven by the head portion 11, the head portion and the barrel of the socket can thus not be easily worn out or damaged.

Accordingly, the wrench in accordance with the present invention includes an engaging surface in which the contact portion of the engaging surface and the barrel is surface which is greatly larger than points such that the engaging surface and the barrel of the socket will not be easily worn out or damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet wrench assembly for driving a headed fastener, comprising:

a) a wrench having a handle portion and a head portion located at one end of the handle portion, the head portion defining an opening;

b) a sleeve located in the opening such that the sleeve may rotate with respect to the head portion in one direction and may rotate with the head portion in an opposite direction, the sleeve defining an inner, substantially cylindrical engaging surface having a plurality of substantially semi-cylindrical ribs projecting radially inwardly from the inner cylindrical engaging surface; and, c) a socket having a protion for engaging a headed fastener and a barrel portion defining a plurality of depressions each having a substantially semi-circular cross-sectional configuration to receive the semi-cylindrical ribs therein, whereby the semi-cylindrical ribs and the semi-cylindrical depressions from contact surfaces when the barrel portion of the socket is inserted into the sleeve to be driven by the wrench.

2. The ratchet wrench assembly of claim 1 further comprising:

a) a slot defined by each of the substantially semi-circular ribs, the slots being in alignment with each other to form a first annular groove;

b) a second annular groove defined by the outer surface of the barrel portion of the socket located such that the first and second annular grooves are in alignment when the socket is located in the sleeve; and, c) a ring member engaged with the first and second annular grooves so as to retain the socket in the sleeve member.

* * * * *